United States Patent [19]

Nestor et al.

[11] Patent Number: 4,720,157

[45] Date of Patent: Jan. 19, 1988

[54] ELECTRICAL CONNECTOR HAVING RESILIENT CONTACT MEANS

[75] Inventors: Charles R. Nestor, Niles; Robert G. Plyler, Vienna, both of Ohio

[73] Assignee: General Motors Corporation, Detroit, Mich.

[21] Appl. No.: 925,812

[22] Filed: Oct. 30, 1986

[51] Int. Cl.[4] ..... H01R 13/11

[52] U.S. Cl. ..... 439/851

[58] Field of Search ..... 339/255 RT, 256 R, 256 RT, 339/256 S, 262 R

[56] References Cited

U.S. PATENT DOCUMENTS

| | | | |
|---|---|---|---|
| 1,833,145 | 11/1931 | Wilhelm | 339/256 R |
| 3,314,044 | 4/1967 | Powell | 339/256 |
| 3,396,364 | 8/1968 | Bonhomme | 339/217 |
| 3,641,483 | 2/1972 | Bonhomme | 339/217 |
| 4,203,647 | 5/1980 | Bonhomme | 339/256 R |
| 4,657,335 | 4/1987 | Koch et al. | 339/256 R |

FOREIGN PATENT DOCUMENTS

| | | | |
|---|---|---|---|
| 469177 | 7/1975 | U.S.S.R. | 339/256 RT |

*Primary Examiner*—Joseph H. McGlynn
*Attorney, Agent, or Firm*—F. J. Fodale

[57] ABSTRACT

An electrical connector socket comprises a sleeve member of conducting material, a support member having two juxtaposed pieces coaxially surrounding the sleeve member, and resilient contact means in the form of a stamped sheet metal cylinder. The stamped sheet metal cylinder has a pair of longitudinally spaced bands which are connected to each other by a plurality of resilient longitudinal contact strips which extend obliquely to the longitudinal axis of the sleeve when the stamped sheet metal cylinder is secured to the sleeve member in a twisted condition by the two juxtaposed pieces of the support member.

11 Claims, 8 Drawing Figures

ELECTRICAL CONNECTOR HAVING RESILIENT CONTACT MEANS

This invention relates generally to electrical connectors and more specifically to electrical connectors having resilient contact means and to a method for making such electrical connectors.

BRIEF SUMMARY OF THE INVENTION

U.S. Pat. Nos. 3,470,527; 3,557,428 and 3,858,962 which issued to Francois Bonhomme Sept. 30, 1969; Jan. 26, 1971 and Jan. 7, 1975 all disclose an electrical connector socket comprising an inner tubular sleeve of conducting material, an outer tubular part coaxially surrounding the sleeve, and resilient contact means in the form of a plurality of resilient conducting wires. The conducting wires extend obliquely to the longitudinal axis of the tubular sleeve and the ends of the conducting wires are secured by the respective ends of the tubular sleeve so that the conducting wires resiliently engage a plug as it is inserted into the tubular sleeve.

The object of this invention is to provide an improved electrical connector of the above noted type, which has fewer parts, increased surface contact with the mating part, increased current capacity and which is easier and cheaper to manufacture.

A feature of the invention is that the electrical connector has a stamped sheet metal cylinder in lieu of the several conducting wires which provide the resilient contact means in the prior art electrical connectors discussed above.

Another feature of the invention is that the electrical connector uses resilient sheet metal strips which provide increased surface contact with the mating connector in comparison to the prior art electrical connectors which use several conducting wires to provide a resilient contact means.

Still yet another feature of the invention is that the electrical connector has a higher current capacity than the prior art electrical connectors which use several conducting wires to provide a resilient contact means.

Other objects and features of the invention will become apparent to those skilled in the art as the disclosure is made in the following detailed description of a preferred embodiment of the invention as illustrated in the accompanying sheet of drawing.

DETAILED DESCRIPTION

Figure 1:
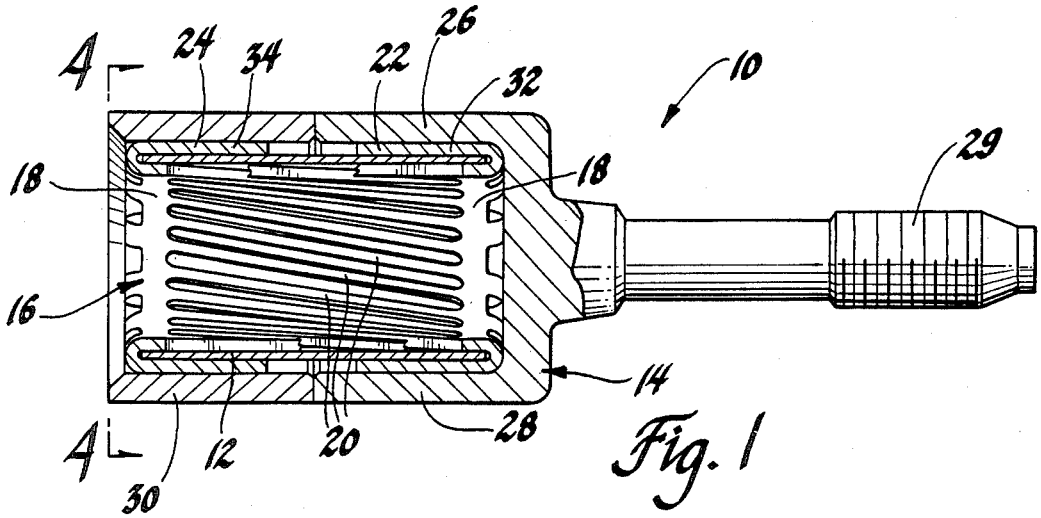
FIG. 1 is a longitudinal sectional view of an electrical connector in accordance with the invention.
Figure 2:
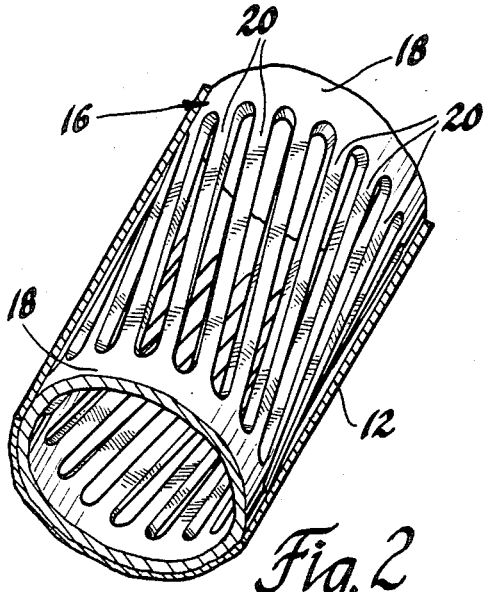
FIG. 2 is a perspective fragmentary view of internal components of the electrical connector shown in FIG. 1 looking in the direction of the arrows.
Figure 4:
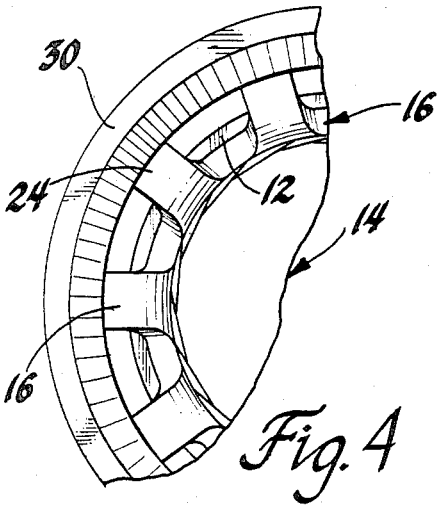
FIG. 4 is an end view of the electrical connector taken substantially along the line 5—5 of FIG. 1 looking in the direction of the arrows.

Referring now to the drawing and more particularly to FIGS. 1, 2 and 4, an electrical connector having resilient contact means in accordance with this invention is illustrated as an electrical connector socket 10 comprising a sleeve member 12, a support member 14 and resilient contact means in the form of a stamped sheet metal cylinder 16 which is disposed inside the sleeve member 12.

Figure 3:
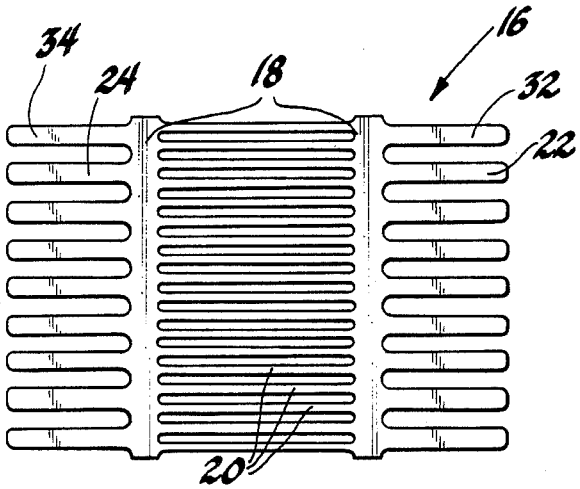
FIG. 3 is a plan view of a sheet metal stamping which is used to make a component of the electrical connector shown in FIGS. 1 and 2.
Figure 5:
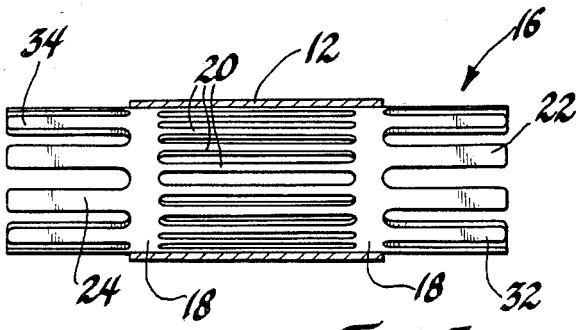
FIG. 5 is a longitudinal sectional view of a subassembly which includes the sheet metal stamping of FIG. 3 after the stamping has been rolled into a cylinder.
Figure 6:
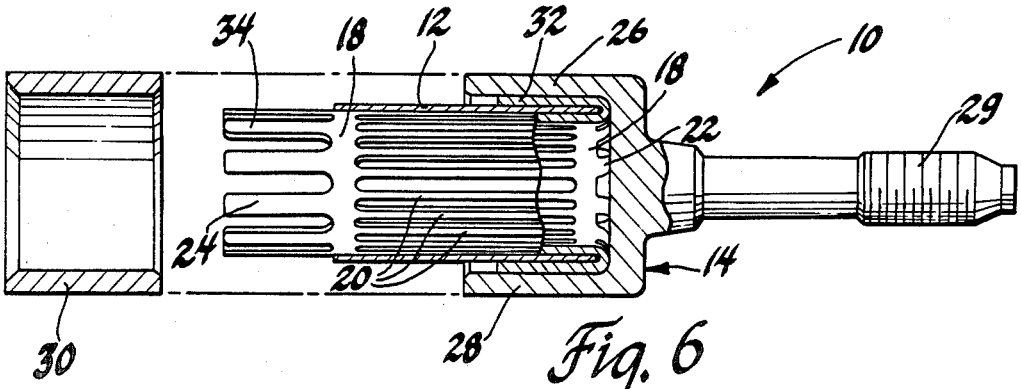
FIG. 6 is a longitudinal sectional view showing the electrical connector of FIGS. 1, 2 and 4 in the process of being assembled using the subassembly shown in FIG. 5.

The stamped sheet metal cylinder 16, which is preferably made of a high conductivity material such as brass or beryllium copper, comprises a pair of longitudinally spaced bands 18 which are connected to each other by a plurality of resilient longitudinal contact strips 20. These resilient longitudinal contact strips 20 are parallel to each other in the sheet metal stamping which is shown in FIG. 3 and the contact strips 20 are parallel to the longitudinal axis of the initial cylinder which is rolled from the sheet metal stamping and which is shown in FIGS. 5 and 6.

When the stamped sheet metal cylinder 16 is incorporated in the electrical connector socket 10, however, the resilient longitudinal contact strips 20 extend obliquely to the longitudinal axis of the sleeve member 14 as best shown in FIGS. 1 and 2.

The electrical connector socket 10 has means for thus securing the stamped sheet metal cylinder 16 comprising first and second set of clamp tabs 22 and 24. These clamp tabs extend outwardly from the respective bands 18 in the longitudinal direction and are clamped against the sleeve member 12 as shown in FIGS. 1 and 4.

The sleeve member 12 is relatively thin, relatively rigid and electrically conductive and may be made from brass tubing. The support member 14 which may also be made of brass comprises a first piece 26 which includes a cup portion 28 and a stem 29 which is externally threaded for securing the electrical connector socket 10 to an electrical device, such as an alternator (not shown), to provide a terminal for the electrical device.

The second piece 30 of the support member 14 is ring-shaped. It has the same wall thickness and diameters as the circumferential wall of the cup portion 28 of the first piece 26 and is juxtaposed the cup portion 28 as shown in FIG. 1.

The first set of clamp tabs 22 of the stamped sheet metal cylinder 16 are bent around one longitudinal end of the sleeve member 12 and the ends 32 of the clamp tabs 22 are disposed between the sleeve member 12 and the circumferential wall of the cup portion 28 which is press fitted over the ends 32 whereby the first piece 26 of the support member 14 clamps the first set of clamp tabs 22 against the sleeve member 12. The ends 32 of the bent clamp tabs 22 are of sufficient length so as to stabilize the first piece 26 of the support member 14 with respect to the sleeve member 12 in the radial direction.

The second set of clamp tabs 24 of the stamped sheet metal cylinder 16 are bent around the opposite longitudinal end of the sleeve member 12 and the ends 34 of the clamp tabs 24 are disposed between the sleeve member 12 and the ring-shaped piece 30 which is press fitted over the ends 34 whereby the ring-shaped second piece 30 of the support member 14 clamps the second set of clamp tabs 24 against the sleeve member 12. The ends 34 of the bent clamp tabs 24 are also of sufficient length so as to stabilize the second piece 26 of the support member 14 with respect to the sleeve member 12 in the radial direction.

As indicated above, the stamped sheet metal cylinder 16 is clamped at the opposite longitudinal ends of the sleeve member 12 so that the resilient contact strips 20 which were originally parallel to the axis of the sleeve member 12 extend obliquely to the longitudinal axis of the sleeve member 12 under tension. Because of this oblique orientation, the resilient contact strips 20 are spaced from the inner wall of the sleeve member 12 in the radial direction progressively reaching a maximum radial spacing midway between the ends of the sleeve member 12 as shown in FIGS. 1 and 2. Consequently, the resilient contact strips 20 provide a resilient contact means for engaging a mating contact, such as a pin (not shown) when it is inserted into the sleeve member 12.

Referring now to FIGS. 3, 5 and 6, the electrical connector socket 10 is made in the following manner.

The sheet metal stamping shown in FIG. 3 is rolled to provide a stamped sheet metal cylinder 16 which is shown in FIG. 5. This stamped sheet metal cylinder 16 has a pair of longitudinally spaced bands 18 which are connected to each other by a plurality of resilient longitudinal contact strips 20 and first and second sets of clamp tabs 22 and 24 which extend outwardly from the respective bands in the longitudinal direction. The resilient longitudinal contact strips 20 are parallel to each other and to the longitudinal axis of the stamped sheet metal cylinder 16.

The stamped sheet metal cylinder 16 is then inserted into the conductive sleeve member 12 and concentrically disposed therein as shown in FIG. 5.

The first set of clamp tabs 22 are then bent around one longitudinal end of the conductive sleeve member 12 and the first piece 26 of the support member 14 is assembled so that the cup portion 28 is press fit over the bent over ends 32 to clamp the first set of clamp tabs 22 against the sleeve member 12 at the one longitudinal end as shown in FIG. 6.

The opposite longitudinal end of the stamped sheet metal cylinder 16 is then indexed circumferentially and the second piece 30 of the support member 14 is assembled to clamp the second set of clamp tabs 24 against the sleeve member 12 so as to secure the stamped sheet metal cylinder in a twisted condition whereby the resilient longitudinal contact strips 20 extend obliquely to the longitudinal axis of the sleeve member 12 under tension. This provides a resilient contact means for engaging a mating contact when the mating contact is inserted into the sleeve member 12.

During the last step, the second set of clamp tabs 24 are bent around the opposite longitudinal end of the sleeve member 12 and the ring-shaped second piece 30 of the support member 14 is press fit over the ends 34 of the bent clamp tabs 24 to clamp the second set of clamp tabs 24 against the sleeve member 12 at the opposite longitudinal end.

The opposite longitudinal end of the stamped sheet metal cylinder 16 is preferably indexed about fifteen degrees (15°) circumferentially after the first piece 26 of the support member 14 is press fit over the ends of the first set of clamp tabs 22 so that the longitudinal contact strips 20 which extend obliquely to the longitudinal axis of the sleeve member 12 are stretched slightly without any permanent deformation.

Figure 7:
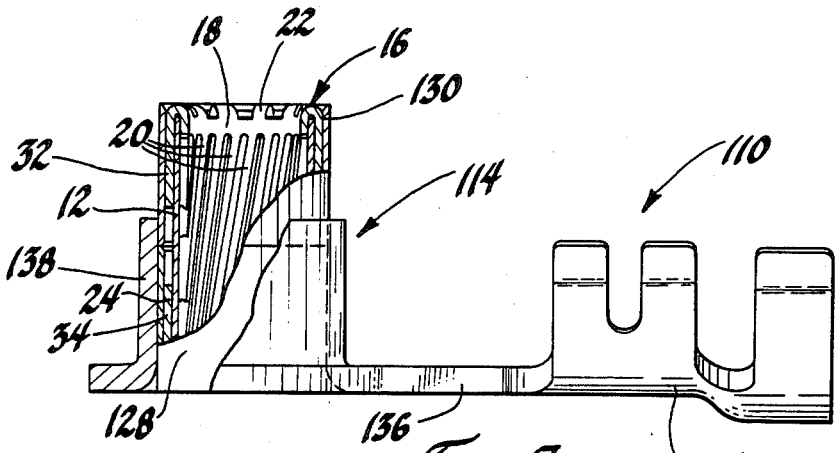
FIG. 7 is a longitudinal sectional view of another electrical connector in accordance with the invention.
Figure 8:
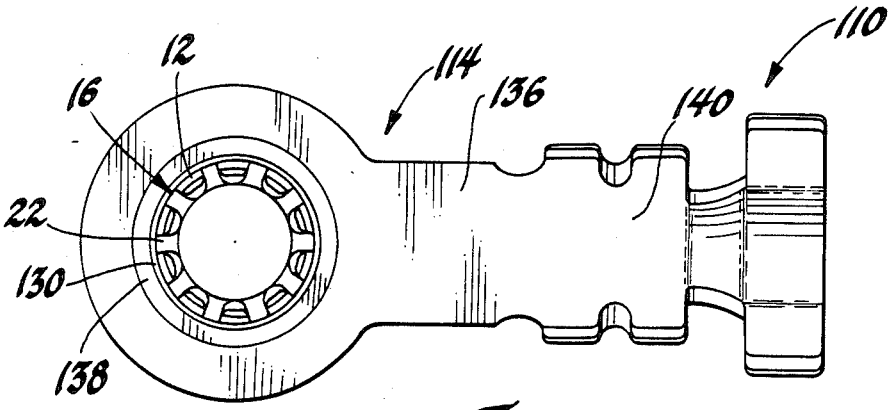
FIG. 8 is a top view of the electrical connector shown in FIG. 7.

FIGS. 7 and 8 show another form of an electrical connector having resilient contact means in accordance with the invention. The electrical connector 110 is an electrical connector socket in which the support member 114 is modified so that it comprises two ring shaped pieces 128 and 130 which are press fitted over the bent over ends 32 and 34 of the respective bent clamp tabs 22 and 24.

These two ring shaped pieces 128 and 130 are disposed in a ring terminal 136 which has a deep drawn cylinder 138 for receiving the juxtaposed ring shaped pieces 128 and 130 and a conventional wire crimp barrel 140 for attaching the terminal to a conductor (not shown).

The electrical socket connector 110 is otherwise the same as the electrical socket connector 10 and corresponding parts are identified by the same numerals.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical connector having resilient contact means comprising:
   - a sleeve member of conducting material having a longitudinal axis,
   - a support member coaxially disposed with respect to the sleeve member, and
   - resilient contact means in the form of a stamped sheet metal cylinder,
   - said stamped sheet metal cylinder comprising a pair of longitudinally spaced bands which are connected to each other by a plurality of resilient longitudinal contact strips, and
   - said stamped sheet metal cylinder being secured to the sleeve member so that the resilient longitudinal contact strips extend obliquely to the longitudinal axis of the sleeve member whereby the resilient longitudinal contact strips provide resilient contact means which engage a mating contact when the mating contact and the sleeve member are disposed in a nested relationship.

2. The electrical connector as defined in claim 1 wherein the support member comprises a first piece which cooperates with the sleeve member to secure the stamped sheet metal cylinder at one longitudinal end by means of a first set of clamp tabs of the stamped sheet metal cylinder and a second piece which cooperates with the sleeve member to secure the stamped sheet metal cylinder at the other longitudinal end by means of the second set of clamp tabs of a stamped sheet metal cylinder.

3. The electrical connector as defined in claim 2 wherein the stamped sheet metal cylinder is disposed inside the sleeve member and the pieces of the support member surround the sleeve member so as to provide an electrical connector socket.

4. The electrical connector as defined in claim 3 wherein the clamp tabs of the cylinder are bent around the longitudinal ends of the sleeve member and the ends of the clamp tabs are disposed between the sleeve member and the support members; the ends of the bent clamp tabs being of sufficient length to stabilize the first and second pieces of the support member with respect to the sleeve member in the radial direction.

5. An electrical connector having resilient contact means comprising:

a sleeve member of conducting material having a longitudinal axis, a support member which includes a first piece and a second piece which coaxially surrounds the sleeve member, and resilient contact means in the form of a stamped sheet metal cylinder which is disposed inside the sleeve member, said stamped sheet metal cylinder comprising a pair of longitudinally spaced bands which are connected to each other by a plurality of resilient longitudinal contact strips and first and second sets of clamp tabs which extend outwardly from the respective ends of the bands in the longitudinal direction, and said stamped sheet metal cylinder being secured to the sleeve member by the first and second sets of clamp tabs so in a twisted position so that the resilient longitudinal contact strips extend obliquely to the longitudinal axis of the sleeve member whereby the resilient longitudinal contact strips provide resilient contact means which engage a mating contact when the mating contact is inserted into the sleeve member, the first piece of the support member cooperating with the sleeve member to clamp the first of clamp tabs to secure the stamped sheet metal cylinder at one longitudinal end, and the second piece of the support member cooperating with the sleeve member to the second set of clamp tabs to secure the stamped sheet metal cylinder at the other longitudinal end.

6. The electrical connector as defined in claim 5 wherein the clamp tabs of the stamped sheet metal cylinder are bent around the longitudinal ends of the sleeve member and the ends of the bent clamp tabs are disposed between the sleeve member and the support member; the ends of the bent clmap tabs being of sufficient length to stabilize the first and second pieces of the support member with respect to the sleeve member in the radial direction.

7. The electrical connector as defined in claim 6 wherein at least one of the first and second pieces of the support member is electrically conductive and includes means for securing the electrical connector to an electrical device.

8. The electrical connector as defined in claim 6 wherein at least one of the first and second pieces of the support member is electrically conductive and is disposed in a ring terminal for securing the electrical connector to an electrical conductor.

9. A method of making an electrical connector having resilient contact means comprising:

providing a sleeve member of conducting material having a longitudinal axis, providing a stamped sheet metal cylinder which has a pair of longitudinally spaced bands which are connected to each other by a plurality of resilient longitudinal contact strips, inserting the stamped sheet metal cylinder into the sleeve member, providing a support member which includes a first piece and a second piece, assembling the first piece so as to secure the stamped sheet metal cylinder at one longitudinal end, and indexing the opposite longitudinal end of the stamped sheet metal cylinder circumferentially and assembling the second piece so as to secure the stamped sheet metal cylinder in an indexed position at the opposite longitudinal end whereby the resilient longitudinal contact strips extend obliquely to the longitudinal axis of the sleeve member under tension to provide a resilient contact means for engaging a mating contact when the mating contact is inserted into the sleeve member.

10. The method of making an electrical connector as defined in claim 9 wherein;

the stamped sheet metal cylinder has first and second sets of clamp tabs which extend outwardly from the respective bands in the longitudinal direction wherein;

the first set of clamp tabs are bent around a first longitudinal end of the sleeve member and the first piece of the support member is press fit over the ends of the bent first set of clamp tabs to clamp the first set of clamp tabs against the sleeve member, and wherein the second set of clamp tabs are bent around a second longitudinal end of the sleeve member and the second piece of the support member is press fit over the ends of the bent second set of clamp tabs to clamp the second set end tabs against the sleeve member.

11. The method of making an electrical connector as defined in claim 9 wherein the opposite longitudinal end of the stamped sheet metal cylinder is indexed about fifteen degrees circumferentially after the first piece of the support member is press fit over the ends of the bent first set of clamp tabs to clamp the first set of clamp tabs against the sleeve member so that the longitudinal contact strips which extend obliquely to the longitudinal axis of the sleeve member are stretched slightly without any permanent deformation.

* * * * *